US006604689B1

(12) United States Patent
Briggs

(10) Patent No.: US 6,604,689 B1
(45) Date of Patent: Aug. 12, 2003

(54) RAILROAD COMMUNICATION TIE

(75) Inventor: Alan Briggs, Lemont, IL (US)

(73) Assignee: Tie & Track Systems, Inc., Lemont, IL (US)

( * ) Notice: Subject to any disclaimer, the term of this patent is extended or adjusted under 35 U.S.C. 154(b) by 0 days.

(21) Appl. No.: 10/188,560

(22) Filed: Jul. 5, 2002

(51) Int. Cl.[7] ..... E01B 3/00
(52) U.S. Cl. ..... 238/60
(58) Field of Search ..... 238/70, 60, 61, 238/59; 104/275

(56) References Cited

U.S. PATENT DOCUMENTS

| | | | | | |
|---|---|---|---|---|---|
| 594,465 | A | * | 11/1897 | Crane | 104/275 |
| 776,342 | A | * | 11/1904 | McCormick | 238/70 |
| 1,251,508 | A | * | 1/1918 | Gregg | 238/60 |
| 1,586,052 | A | * | 5/1926 | Snyder | 238/61 |
| 1,670,994 | A | * | 5/1928 | Snyder et al. | 238/60 |
| 1,936,824 | A | * | 11/1933 | Buchholz | 238/61 |
| 2,057,593 | A | * | 10/1936 | Riggle et al. | 238/70 |
| 4,417,690 | A | * | 11/1983 | Langman | 238/59 |
| 4,728,030 | A | * | 3/1988 | Hodgson | 238/61 |
| 5,836,512 | A | | 11/1998 | Briggs | 238/60 |

* cited by examiner

*Primary Examiner*—S. Joseph Morano
*Assistant Examiner*—Lars A. Olson
(74) *Attorney, Agent, or Firm*—Anthony S. Zummer

(57) ABSTRACT

A railroad communication tie for use in a railway track system is positionable in ballast. The tie includes an elongated unitary steel channel body having a web and a pair of sidewalls formed integral with opposite edges of the web. The channel body has a pair of opposed ends. A flared spade is formed integral with each end of the body. The flared spade has a communications conduit aperture. An elongated communications conduit is movably mounted in the communications conduit apertures and said conduit is free to move relative to the spades.

13 Claims, 2 Drawing Sheets

RAILROAD COMMUNICATION TIE

BACKGROUND OF THE INVENTION

The utilization of remote controlled motorized switches in a railroad track system allows a railroad employee, such as a tower operator, to operate a switch from a remote location, such as a tower. The attitude of the switch may be reflected on a control board display or other device. The operation of a remote controlled motorized switch and the communication of the attitude of the motorized switch back to a control board display requires that communication cables or wires extend between the motorized switch and the switch operator control at the control board display. The communication cables necessarily pass under tracks of the track system. Operation of railroad cars on the tracks cause track rails to flex and cause movement of a supporting tie and ballast surrounding the tie. The movement of ballast under a track has a tendency to wear away insulation material from communication cables. It is desirable to provide a construction for protecting the communication cable insulation from wear by ballast and other abrasive materials.

Unitary steel railroad ties, such as that disclosed in U.S. Pat. No. 5,836,512, issued Nov. 17, 1998, to Alan Briggs, entitled, "Unitary Steel Railroad Tie" are used in certain railroad track systems. An improved tie construction is required for protecting a communications cable when communication cable is used in conjunction with a steel railroad tie.

SUMMARY OF THE INVENTION

The present invention is an improved railroad communication tie which has a unitary steel main body positionable in conventional ballast for use as part of a railway track system. The communication tie includes an elongated steel channel body having a web and a pair of sidewalls formed integral with opposite edges of the web. The web has an elongated substantially level center portion and an inclined portion extending away in opposite directions from each end of the central portion. An integral rail seat is formed in each of the inclined portions and is adapted for connecting a rail to the web. The channel body has a pair of opposed ends with a flared spade formed integral with each end. Each flared spade has a communications conduit aperture. The communication tie includes an elongated communications conduit movably mounted in each communications conduit aperture in the flared spades. The web has a communications web aperture formed therein at each end of the level central portion. A pair of tubules is mounted on the conduit and communicates with the interior of the conduit. Each tubule communicates with a respective communications web aperture. A stop is mounted adjacent to each end of the conduit allowing the conduit to move a small amount relative to the steel main body, but preventing extensive movement of the conduit relative to the main body. The communications conduit provides a passage under rails mounted on the tie. A communications cable passes under the rails and is protected from the ballast as the tie flexes with passage of railway cars over the tie.

DETAILED DESCRIPTION OF THE DRAWINGS

Figure 1:
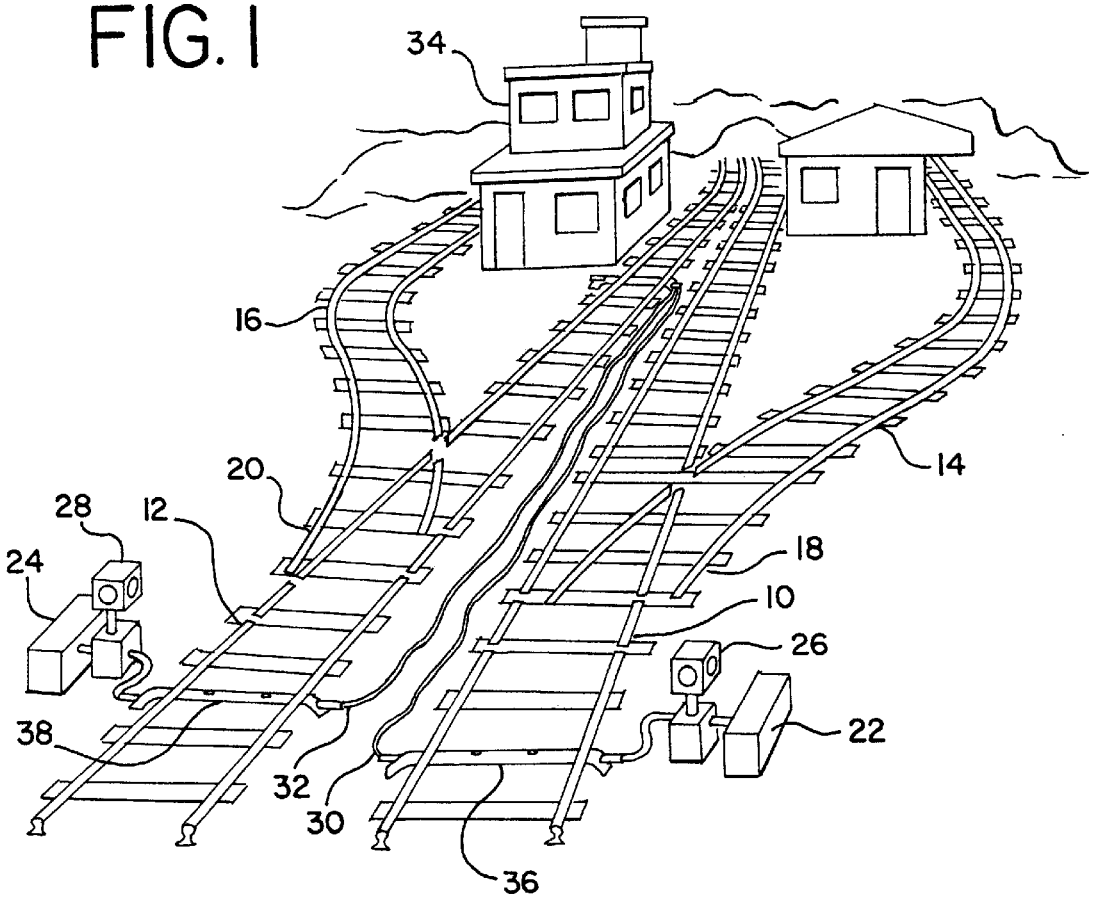
FIG. 1 is a perspective view of a portion of a railway track system showing remote controlled switches having communication cables communicating with a control tower.
Figure 7:
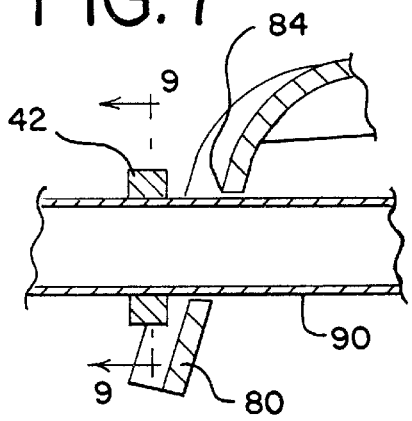
FIG. 7 is an enlarged cross sectional view showing a portion of a communications conduit mounted in a portion of a spade of the tie with a stop mounted on the communications conduit.
Figure 8:
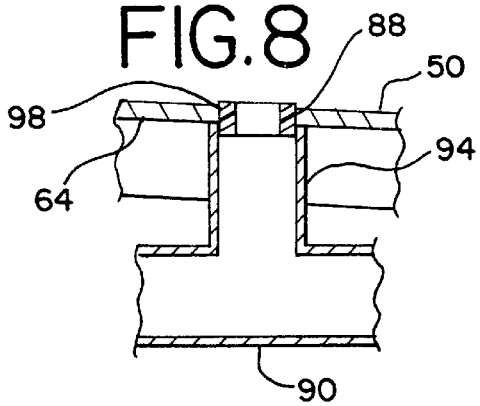
FIG. 8 is an enlarged cross sectional view showing a portion of the communications conduit with a tubule having one end connected to the conduit and a crown connector in the other end of the tubule and being connected to a communications web aperture in the web of the tie.

Referring now to the drawings and especially to FIG. 1, a portion of a track system is shown therein with a pair of parallel tracks 10 and 12 connected to tracks 14 and 16, respectively, through conventional switches 18 and 20. The connection of the switch to the track and operation thereof are well known in the art and are not set forth herein. Conventional switches 18 an 20 are operated by remote controlled motorized switch operators 22 and 24, respectively. Switches 18 and 20 have signals 26 and 28, respectively, mounted thereon to display the attitude of the switches. The switch operators 22 and 24 are connected to signal cables 30 and 32, which are connected to a control tower 34. Signal cables 30 and 32 pass under respective tracks through railroad communication ties 36 and 38. Ties 36 and 38 are identical in their construction.

Tie 36 generally consists of a unitary steel main tie body 40 with a communications conduit assembly 42 movably mounted therein and held in tie body 40 by a pair of identical collar stops 44 and 46. The conduit assembly 42 and main tie body 40 are movable relative to each other to allow the main tie body to flex when rail cars pan over the main tie body.

Main tie body 40 includes an elongated steel channel body 48 having a web 50 and a pair of sidewalls 52 and 54. Sidewalls 52 and 54 have beads 56 and 58, respectively, formed integral therewith. The web has an elongated flat central portion 60. An inclined portion 62 extends away from one end of the flat portion 60. An inclined portion 64 is formed integral with the other end of flat portion 60 and extends in a direction opposite to inclined portion 62. Inclined portion 64 is a mirror image of inclined portion 62. Indentations 66 and 68 are formed in sidewalls 52 and 54, respectively, adjacent to one end of the body to form a reduced section in the body. Indentations 70 and 72 in sidewalls 52 and 54, respectively, at the other end of the body form a second reduced section. Indentations 66 and 68 form an apex 74 above the reduced section and indentations 70 and 72 form an apex 76 above the second reduced section. Apex 74 is the same relative highest above the remainder of the web as apex 76, and the apexes are the highest part of the web.

A flared spade 78 is formed integral with one end of the channel body and a like flared spade 80 is formed integral with the other end of the channel body. A communications conduit aperture 82 is formed in spade 78, and a like communications conduit aperture 84 is formed in spade 80 and aligned with operation 82. A communications web aperture 86 is formed in the web at the junction of the level center portion 60 and the inclined portion 62. A like communications web aperture 88 is formed at the other end of the level center portion at the junction of the center portion with inclined portion 64.

Communications conduit assembly 42 includes an elongated communications conduit 90 which has a length greater than the length of the elongated steel channel body. The communications conduit has a pair of tubules 92 and 94 threadedly mounted in the side of the conduit. The tubules open into the interior of the communications conduit. The tubules are parallel to each other and are perpendicular to the length of the conduit. However, any other suitable means of securing the tubules to the conduit may be utilized, such as welding. The communications conduit is positioned in the conduit apertures 82 and 84 of spades 78 and 80, respectively. The tubules are then attached to the conduit.

The tubules 92 and 94 have connector crowns 96 and 98, respectively, mounted therein. Each crown in this instance is a suitable resilient plastic material. However, any other suitable material may be used. The connector crowns 96 and 98 are mounted in apertures 86 and 88, respectively.

Figure 9:
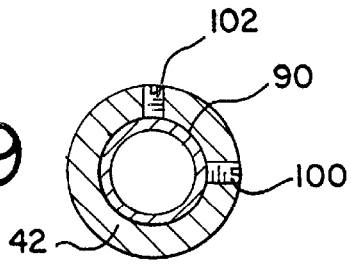
FIG. 9 is a cross sectional view taken on Line 9—9 of FIG. 7 showing a collar stop mounted on the communications conduit.

The collar stops 44 and 46 each have the same construction. Each of the collar stops has set screws 100 and 102 mounted therein, as may be best seen in FIG. 9. Each of the collars is positioned on the conduit adjacent to its respective flared spade, so that the conduit does not impede the normal vibration of the tie as a railway car passes over the tie. However, the collar stops prevent excessive relative movement between the conduit and the main tie body.

Figures 2, 3, 4, 5, 6:
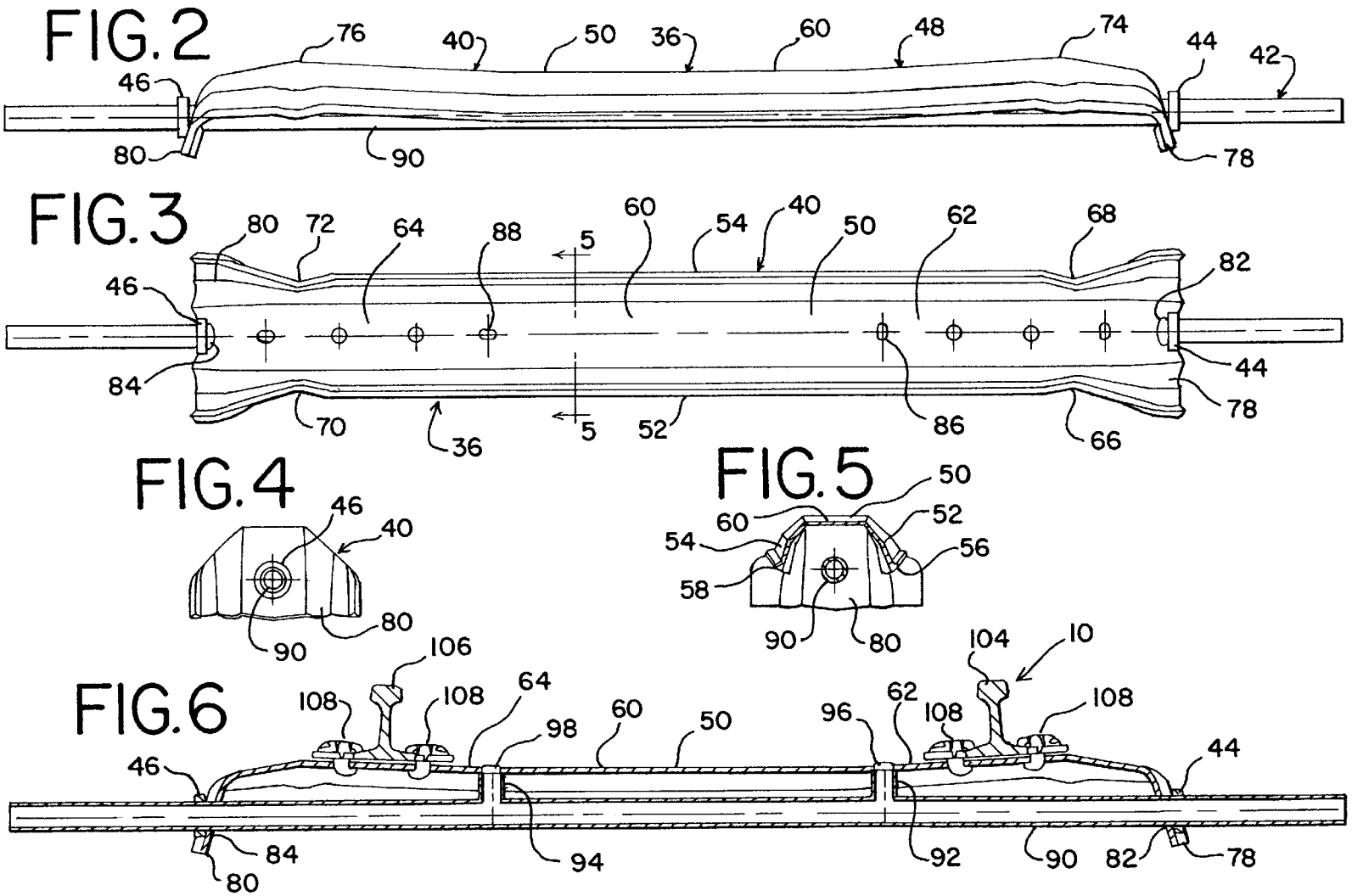
FIG. 2 is a side elevational view of a railroad communication tie embodying the herein disclosed invention.
FIG. 3 is a plan view of the railroad communication tie shown in FIG. 2.
FIG. 4 is an end view of the railroad communication tie shown in FIG 2.
FIG. 5 is a cross sectional view taken on Line 5—5 of FIG. 3.
FIG. 6 is a cross sectional view through the length of the railroad communication tie shown in FIG. 2, and showing a pair of rails mounted on the tie with rail clips holding the rails on the tie.

As may be seen in FIG. 6, track 10 has a pair of rails 104 and 106 secured to inclined portions 62 and 64, respectively, by conventional and well known rail clips 108. Track 12 is mounted on railroad communication tie 38 in the same manner as described above.

A communications cable may be passed under the track by passing the cable through the interior of the communications conduit. The instant tie allows communications cables to be passed under a track and still be protected from wear and tear by the ballast, as the main tie body flexes under the load of passing rail cars. The channel body has limited movement relative to the conduit so that there is no extensive relative movement between the parts.

Although a specific embodiment of the herein disclosed invention has been described in detail above, it is readily apparent that those skilled in the art may make various modifications and changes without departing from the spirit and scope of the invention. It is to be expressly understood that the instant invention is limited only by the appended claims.

What is claimed is:

1. A railroad communication tie positionable in ballast for use in a railway track system comprising: an elongated unitary steel channel body having a web and a pair of sidewalls formed integral with opposite edges of the web, said channel body having a pair of opposed ends, a flared spade formed integral with each end of the body, each flared spade having a communications conduit aperture, and an elongated communications conduit movably mounted in the communications conduit apertures having freedom of movement relative to the spades.

2. A railroad communication tie positionable in ballast for use in a railway track system as defined in claim 1, wherein said communications conduit has a length greater than the length of the channel body, and a stop connected to and adjacent to each end of the conduit preventing extensive movement of the conduit relative to the channel body.

3. A railroad communication tie positionable in ballast for use in a railway track system as defined in claim 1, a tubule mounted on the communications conduit having one end communicating with the interior of the conduit and an opposite end communicating with an aperture in the web.

4. A railroad communication tie positionable in ballast for use in a railway track system as defined in claim 1, including an elongated tubule having one end connected to the communications conduit being substantially perpendicular to the communications conduit and communicating with the interior of the conduit, said tubule having an opposite end connected to an aperture in the web.

5. A railroad communication tie positionable in ballast for use in a railway track system as defined in claim 1, including a tubule having one end mounted on the communications conduit communicating with the interior of the conduit, and a crown connector mounted on an opposite end of the tubule communicating with an aperture in the web.

6. A railroad communication tie positionable in ballast for use in a railway track system as defined in claim 1, including a tubule having one end connected to the conduit and communicating with the interior of the conduit, said tubule being substantially perpendicular to the conduit, and a crown connector mounted on an opposite end of the tubule communicating with an aperture in the web.

7. A railroad communication tie positionable in ballast for use in a railway track system as defined in claim 1, wherein said communications conduit has a length greater than the length of the channel body, a stop mounted on the conduit adjacent to each end of the conduit preventing extensive movement of the conduit relative to the channel body, a tubule having one end secured to the conduit and communicating with the interior of the conduit, said tubule being substantially perpendicular to the conduit, and a crown connector mounted on an opposite end of the tubule communicating with an aperture in the web.

8. A railroad communication tie positionable in ballast for use in a railway track system comprising: an elongated unitary steel channel body having a web and a pair of sidewalls formed integral with opposite edges of the web, said channel body having a pair of opposed ends, said web having an elongated substantial level center portion, said web having an inclined portion extending away from each end of the central portion, an integral rail seat formed in each of the inclined portions and being adapted for connecting a rail to the web, said channel body having a pair of opposed ends, a flared spade formed integral with each end of the body, each flared spade having a communications conduit aperture, an elongated communications conduit movably mounted in the communications conduit apertures having freedom of movement relative to the spades, a communications web aperture formed in the web at each end of the level central portion, a stop adjacent to each end of the conduit preventing extensive movement of the conduit relative to the spades, and a pair of tubules communicating with the interior of the conduit, each tubule communicating with a respective communications web aperture.

9. A railroad communication tie positionable in ballast for use in a railway track system as defined in claim 8, wherein each stop is a collar mounted on the conduit and is engagable with its respective spade.

10. A railroad communication tie positionable in ballast for use in a railway track system as defined in claim 8, wherein each of said tubules is perpendicular to the length of the conduit.

11. A railroad communication tie positionable in ballast for use in a railway track system as defined in claim 8, wherein each of the tubules is perpendicular to the conduit, each tubule having an end spaced away from the conduit, and a crown connector mounted on the end of the tubule spaced away from the conduit and communicating with a respective communication web aperture.

12. A railroad communication tie positionable in ballast for use in a railway track system as defined in claim 8, wherein each stop is a collar mounted on the conduit and engagable with the respective spade, each of said tubules having an end connected to the interior of the conduit, each tubule being substantially perpendicular to the length of the conduit, a crown connector mounted on an end of the tubule spaced from the conduit and communicating with a respective communication web aperture.

13. A railroad communication tie positionable in ballast for use in a railway track system as defined in claim 8, including an indentation in each sidewall adjacent to each end of the body, the indentations at each end being opposed to each other forming an interior reduced section between the sidewalls at each end of the body to restrict movement of ballast toward the respective end along the length of the body between the sidewalls, an apex in the web and directly above each interior reduced section, each apex being substantially the same height as the other apex and being the high points of the web, each of said tubules having an end fixed to the conduit, and a crown connector mounted on an end of the tubule spaced away from the conduit and communicating with a respective communication web aperture.

* * * * *